US010610722B2

(12) United States Patent
Roberts

(10) Patent No.: US 10,610,722 B2
(45) Date of Patent: Apr. 7, 2020

(54) RESISTANCE BAND SYSTEM AND METHOD

(71) Applicant: Starrdanya Roberts, Fargo, ND (US)

(72) Inventor: Starrdanya Roberts, Fargo, ND (US)

( * ) Notice: Subject to any disclaimer, the term of this patent is extended or adjusted under 35 U.S.C. 154(b) by 108 days.

(21) Appl. No.: 16/052,476

(22) Filed: Aug. 1, 2018

(65) Prior Publication Data

US 2019/0038928 A1 Feb. 7, 2019

Related U.S. Application Data

(60) Provisional application No. 62/540,454, filed on Aug. 2, 2017.

(51) Int. Cl.

| | |
|---|---|
| ***A63B 21/00*** | (2006.01) |
| ***A63B 23/035*** | (2006.01) |
| ***A63B 21/28*** | (2006.01) |
| ***A63B 21/055*** | (2006.01) |
| ***A63B 23/04*** | (2006.01) |
| ***A63B 21/04*** | (2006.01) |
| *A63B 21/02* | (2006.01) |

(52) U.S. Cl.

CPC ..... *A63B 21/4025* (2015.10); *A63B 21/0442* (2013.01); *A63B 21/0552* (2013.01); *A63B 21/28* (2013.01); *A63B 21/4011* (2015.10); *A63B 23/03516* (2013.01); *A63B 23/047* (2013.01); *A63B 21/00189* (2013.01); *A63B 21/028* (2013.01)

(58) Field of Classification Search

CPC ..... A63B 21/00189; A63B 21/028; A63B 21/0442; A63B 21/0552; A63B 21/28; A63B 21/4011; A63B 21/4025; A63B 23/03516; A63B 23/047

See application file for complete search history.

(56) References Cited

U.S. PATENT DOCUMENTS

| | | | | |
|---|---|---|---|---|
| 3,966,204 | A * | 6/1976 | Dubach | A63B 21/00 482/93 |
| 5,167,601 | A * | 12/1992 | Frappier | A63B 21/0004 482/121 |
| 5,344,373 | A | 9/1994 | Greene | |
| 5,951,443 | A * | 9/1999 | Askins | A63B 23/047 482/124 |
| 7,137,935 | B2 | 11/2006 | Clarke et al. | |
| 7,699,761 | B1 * | 4/2010 | Dieter | A63B 23/04 482/124 |
| 8,979,716 | B1 * | 3/2015 | Rawlins | A63B 21/0442 482/91 |
| 9,427,622 | B2 * | 8/2016 | Thrasher-Rudd | A63B 21/00061 |
| 9,433,824 | B2 * | 9/2016 | Thompson | A63B 21/062 |
| 9,586,074 | B2 * | 3/2017 | Autogue | A63B 23/0355 |

(Continued)

*Primary Examiner* — Joshua Lee

(74) *Attorney, Agent, or Firm* — Charles Runyan

(57) ABSTRACT

A resistance band system is disclosed herein. The resistance band system includes a strap and a resistance band having a first-connection point at one end and a second-connection point at an opposing end. A pair of leg wraps are connected to the first-connection point and the second-connection point. A plurality of connectors can be utilized to connect the pair of leg wraps to the first-connection point and the second-connection point and connect the second-end of the strap to a middle-point along the resistance band. The resistance band system is useful for improving leg cycle training.

17 Claims, 5 Drawing Sheets

(56) References Cited

U.S. PATENT DOCUMENTS

| | | | | |
|---|---|---|---|---|
| 10,238,908 | B2 * | 3/2019 | Cummings | A63B 23/047 |
| 10,486,008 | B2 * | 11/2019 | Prihar | A63B 23/12 |
| 2002/0187884 | A1 | 12/2002 | McGrath | |
| 2010/0048366 | A1 * | 2/2010 | Lebert | A63B 21/0023 482/126 |
| 2010/0173273 | A1 * | 7/2010 | Bilbao | A63B 21/4015 434/253 |
| 2012/0053027 | A1 | 3/2012 | Hetrick | |
| 2014/0141947 | A1 * | 5/2014 | Pickell, III | A63B 21/153 482/125 |
| 2015/0005141 | A1 | 1/2015 | Krahling et al. | |
| 2017/0225024 | A1 * | 8/2017 | Thrasher-Rudd | A63B 21/0552 |

* cited by examiner

RESISTANCE BAND SYSTEM AND METHOD

CROSS-REFERENCE TO RELATED APPLICATION(S)

The present application is related to and claims priority to U.S. Provisional Patent Application No. 62/540,454 filed Aug. 2, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

Technical Field

The present invention relates generally to the field of exercise devices of existing art and more specifically relates to a resistance device for improving leg cycling.

Related Art

Many people enjoy exercising. Physical exercise is any bodily activity that enhances or maintains physical fitness and overall health and wellness. It is performed for various reasons, including increasing growth and development, preventing aging, strengthening muscles and the cardiovascular system, honing athletic skills, weight loss or maintenance, and merely enjoyment.

Some physical exercise, like track and field, require leg cycle exercise which can build power and strength in major leg muscles. In order for runners to improve leg cycle and increase running times, a good amount of technical training and drills are required. Leg cycle regimens without supportive equipment can take months or more. A more efficient and less time-consuming method is desired.

U.S. Pub. No. 2012/0053027 to Randal Hetrick relates to a strap restraint apparatus. The described strap restraint apparatus includes a strap restraint for a device having adjustable straps. In one embodiment, a strap restraint for an adjustable device is provided. The device has a strap with an end that doubles back through a length-adjustment mechanism and over the strap. The strap restraint includes an elastic band attached to the end, where the band encircles the strap, and a pair of flexible inelastic fastening elements attached to the end. The strap restraining permits the user to select the force with which the strap restraint holds the end against the strap.

SUMMARY OF THE INVENTION

In view of the foregoing disadvantages inherent in the known leg cycling art, the present disclosure provides a novel resistance band system and method. The general purpose of the present disclosure, which will be described subsequently in greater detail, is to provide a resistance band system and method for improving leg cycle training.

A resistance band system is disclosed herein. The resistance band system includes a strap including a first-end, a second-end, and a length member therebetween. The resistance band system further includes a resistance band having a first-connection point at one end and a second-connection point at an opposing end. A pair of leg wraps may be connected to the first-connection point and the second-connection point and configured to fasten around a user's leg above the knees. A plurality of connectors may connect the pair of leg wraps to the first-connection point and the second-connection point and further connect the second-end of the strap to a middle-point along the resistance band.

According to another embodiment, a method of using a resistance band system is also disclosed herein. The method includes providing the resistance band system as described above, fastening the pair of leg wraps around the user's leg above the knees on each side, and holding the first-end as a handle by an assistant while the user is in motion such that resistance is applied to the legs of the user.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a resistance band system and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to exercises for leg cycles and more particularly to a resistance band system and method as used to improve leg cycling training and regimen.

Generally, the present invention provides a system to perfect a user's running technique and drive phase, while helping the user to get in shape and build strength in the leg muscles. The resistance band system is a tool to be used by trainers and athletes for obtaining proper technical leg cycle to increase speed. It includes a resistance band that connects to the user's legs right above the knees. This may eliminate technical training and drills that are more time consuming. The present invention helps runners or users to increase time and improve running technique more quickly and efficiently.

Referring now more specifically to the drawings by numerals of reference, there is shown in FIGS. 1-4, various views of a resistance band system 100.

Figure 1:
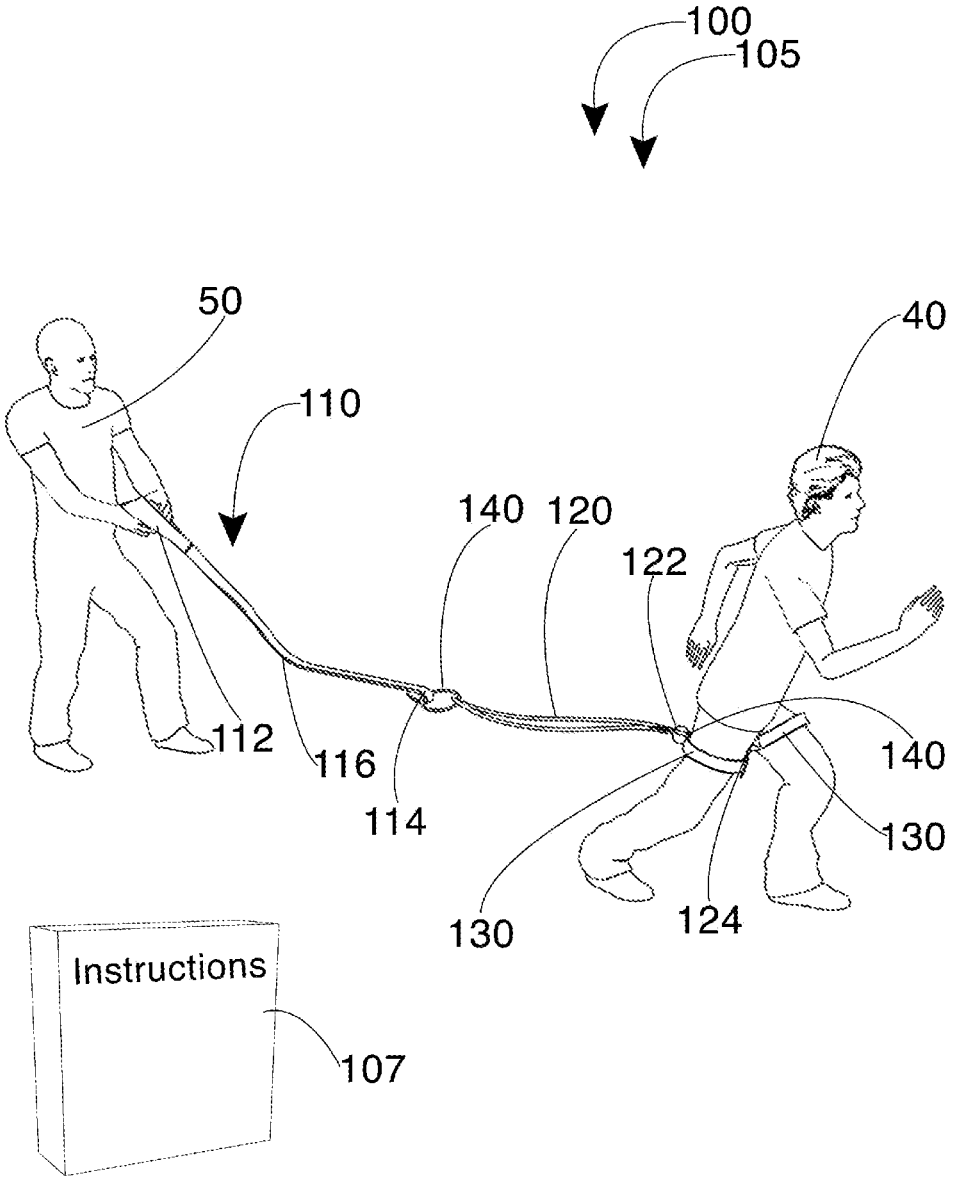
FIG. 1 is a perspective view of the resistance band system during an 'in-use' condition, according to an embodiment of the disclosure.

FIG. 1 shows a resistance band system during an 'in-use' condition, according to an embodiment of the present disclosure. Here, the resistance band system 100 may be beneficial for use by a user 40 to improve leg cycle training. As illustrated, the resistance band system 100 may include a strap 110 having a first-end 112, a second-end 114, and a length member 116 therebetween. The resistance band system 100 further includes a resistance band 120 having a first-connection point 122 at one end and a second-connection point 124 at an opposing end. The resistance band 120 can be interchangeable to different weight resistances to provide differing resistance to stretching. The weight resistance may be at least 10 pounds. In some cases, the resistance band 120 may be a minimum of 6 feet and a maximum of 8 feet.

A pair of leg wraps 130 may be connected to the first-connection point 122 and the second-connection point 124 and configured to fasten around the legs of the user 40 above the knees. The pair of leg wraps 130 may be configured to fasten at least ½ inch above the knees. A plurality of connectors 140 may connect the pair of leg wraps 130 to the first-connection point 122 and the second-connection point 124 and further connect the second-end 114 of the strap 110 to a middle-point along the resistance band 120.

As shown, the first-end 112 may be utilized as a handle configured to be held by an assistant 50 while the user 40 is fastened to the pair of leg wraps 130. The assistant 50 may provide an opposing force to the resistant band 120 while the user 40 is in motion such that resistance is applied to the legs of the user 40. The resistance band 120 comprises an elastic material to enable strength training.

According to one embodiment, the resistance band system 100 may be arranged as a kit 105. In particular, the resistance band system 100 may further include a set of instructions 107. The instructions 107 may detail functional relationships in relation to the structure of the resistance band system 100 such that the resistance band system 100 can be used, maintained, or the like, in a correct manner.

Figure 2:
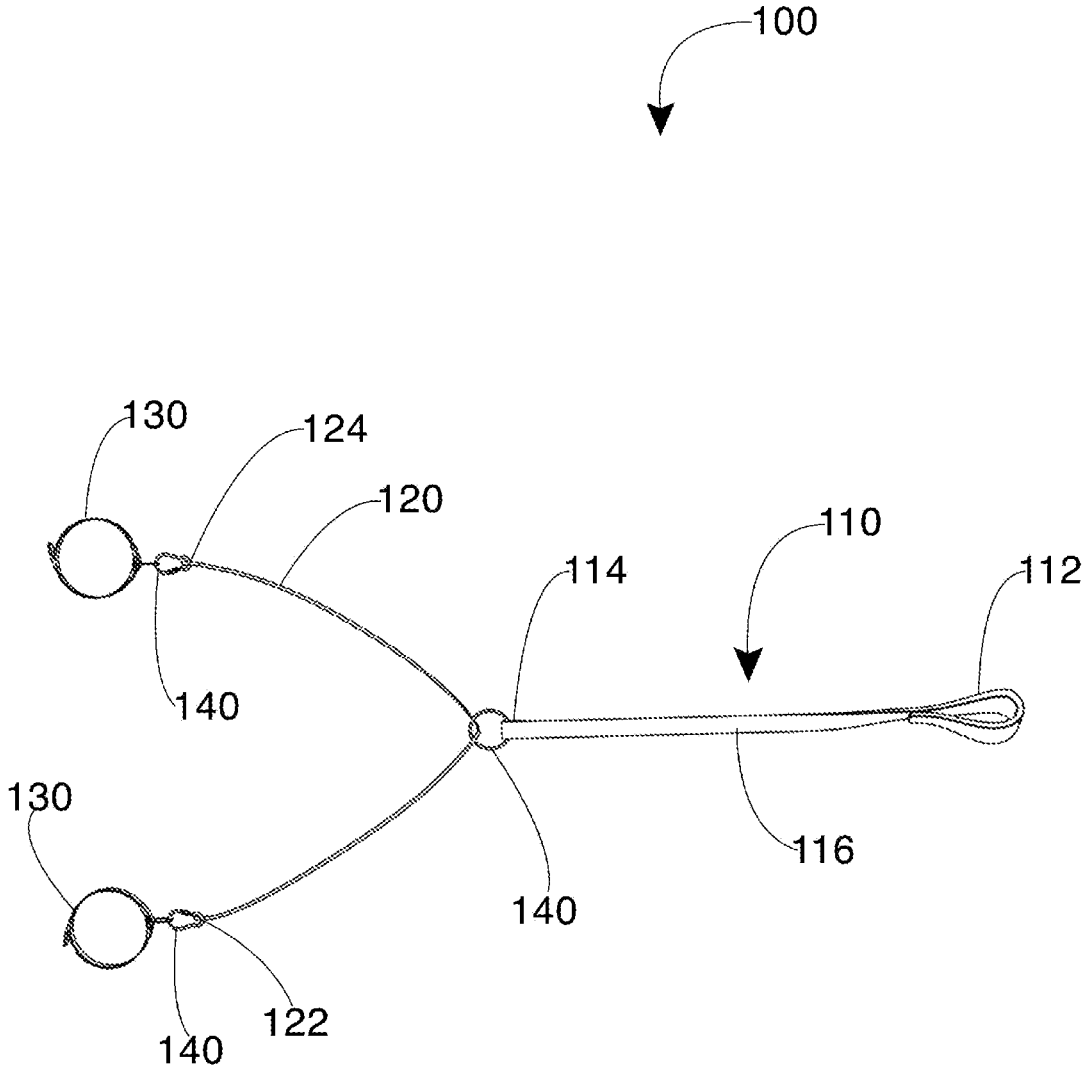
FIG. 2 is a top perspective view of the resistance band system of FIG. 1, according to an embodiment of the present disclosure.

FIG. 2 shows the resistance band system 100 of FIG. 1, according to an embodiment of the present disclosure. As above, the resistance band system 100 may include the strap 110 having the first-end 112, the second-end 114, and the length member 116 therebetween. The resistance band system 100 further includes the resistance band 120 having the first-connection point 122 at one end and the second-connection point 124 at the opposing end. In some embodiments, the first-end 112 and the second-end 114 each form a loop. The loop may allow the first-end 112 to be utilized as the handle (as shown in FIG. 1).

The pair of leg wraps 130 may be connected to the first-connection point 122 and the second-connection point 124 and configured to fasten around the legs of the user 40 above the knees. The pair of leg wraps 130 may be configured to fasten at least ½ inch above the knees.

The plurality of connectors 140 may connect the pair of leg wraps 130 to the first-connection point 122 and the second-connection point 124 and further connect the second-end 114 of the strap 110 to a middle-point along the resistance band 120. The plurality of connectors 140 may be selected from the group consisting of a ring, a clamp, and/or a clip. However, it should be appreciated that the plurality of connectors 140 can include any fastener configured to connect one object to another.

Figure 3:
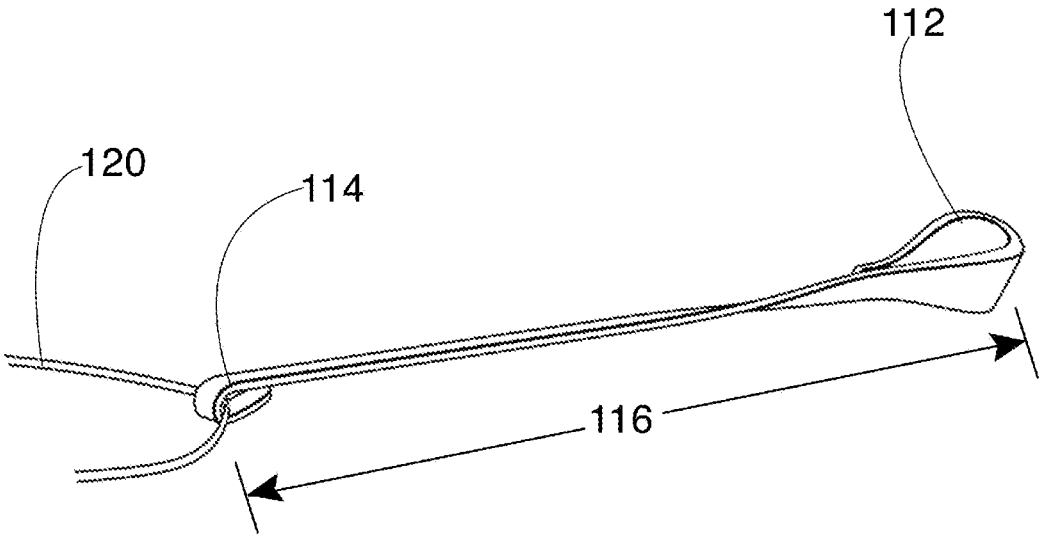
FIG. 3 is a perspective view of the resistance band system of FIG. 1, according to an embodiment of the present disclosure.

FIG. 3 is a perspective view of the resistance band system 100 of FIG. 1, according to an embodiment of the present disclosure. The strap 110 may include the first-end 112, the second-end 114, and the length member 116 therebetween. The length member 116 of the strap 110 may be at least 3 feet for providing an appropriate distance between the resistance band 120 and the assistant 50.

The strap 110 may comprise of a durable material such as a webbing fabric. In one embodiment, the strap 110 comprises a pliable metal insert covered by the webbing fabric. The pliable metal insert may provide a sturdier grip to the first-end 112 utilized as the handle (as shown in FIG. 1) and allow for more durability and stability between the strap 110 and the resistance band 120.

The first-end 112 and the second-end 114 [of the strap 110] each form the loop. In some embodiments, the loop at the second-end 114 may be utilized to thread the resistance band 120 therethrough and configured to be retained at the middle-point along the resistance band 120. In other embodiments (as shown in FIGS. 1 and 2), the resistance band 120 is threaded through one of the plurality of connectors 140 located at the second-end 114. In yet another embodiment (not shown), a pair of resistance bands 120 may be attached to the second-end 114 at one end and include the pair of leg wraps 130 at the opposing end.

Figure 4:
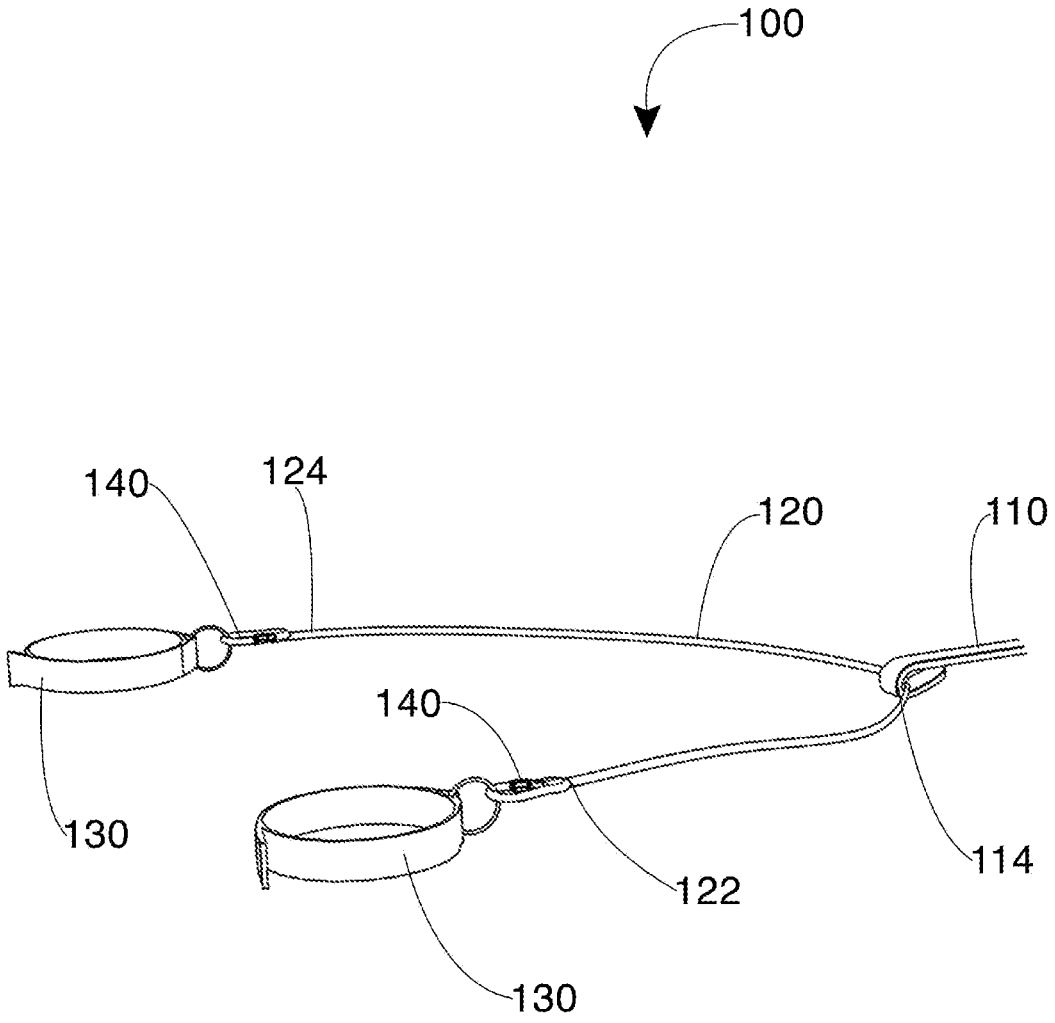
FIG. 4 is a perspective view of the resistance band system of FIG. 1, according to an embodiment of the present disclosure.

FIG. 4 is a perspective view of the resistance band system 100 of FIG. 1, according to an embodiment of the present disclosure. The pair of leg wraps 130 may be connected to the first-connection point 122 and the second-connection point 124 and configured to fasten around the legs of the user 40 above the knees. The pair of leg wraps 130 may be adjustably fastened around the legs of the user 40 above the knees with a hook-and-loop fastener. The plurality of connectors 140 may connect the pair of leg wraps 130 to the first-connection point 122 and the second-connection point 124. The plurality of connectors 140 may be selected from the group consisting of the ring (i.e., D-ring, O-ring, etc.), the clamp, and/or the clip. One or more of these connectors 140 may be utilized in combination with each other. For example, the ring and the clip as shown.

Figure 5:
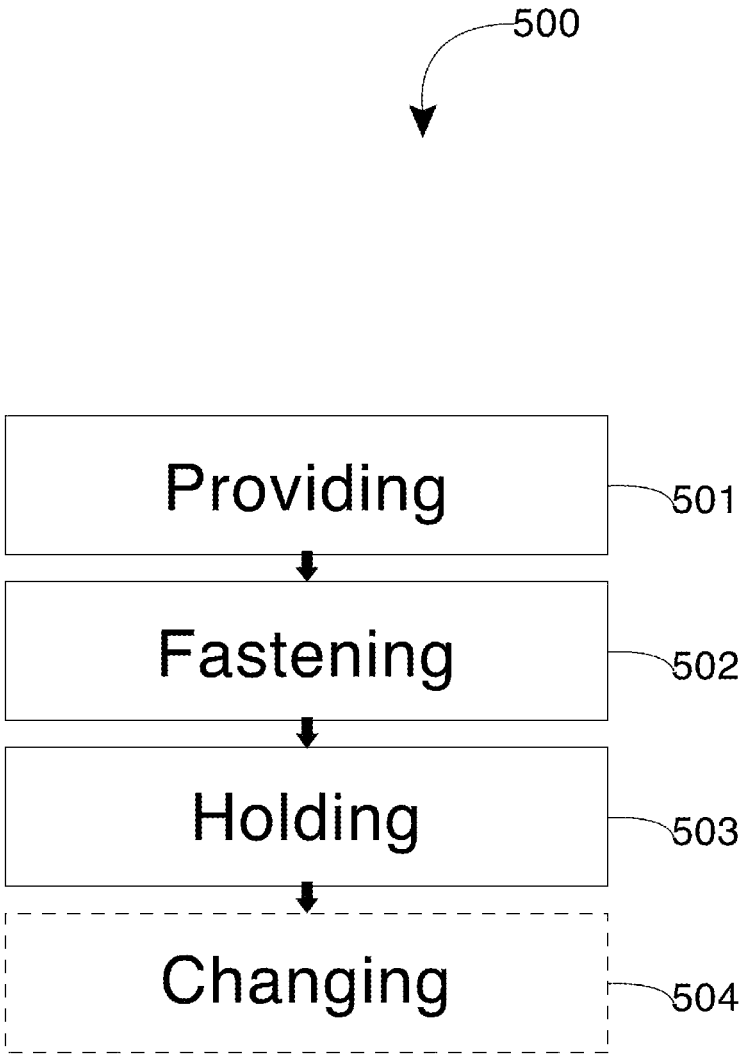
FIG. 5 is a flow diagram illustrating a method of using a resistance band system, according to an embodiment of the present disclosure.

FIG. 5 is a flow diagram illustrating a method for using a resistance band system 500, according to an embodiment of the present disclosure. In particular, the method for using the resistance band system 500 may include one or more components or features of the resistance band system 100 as described above. As illustrated, the method for using the resistance band system 500 may include the steps of: step one 501, providing a strap 110 including a first-end 112, a second-end 114, and a length member 116 therebetween; a resistance band 120 having a first-connection point 122 at one end and a second-connection point 124 at an opposing end; a pair of leg wraps 130 connected to the first-connection point 122 and the second-connection point 124 and configured to fasten around a user's 40 leg above the knees; and a plurality of connectors 140 connecting the pair of leg wraps 130 to the first-connection point 122 and the second-connection point 124 and connecting the second-end 114 of the strap 110 to a middle-point along the resistance band 120; step two 502, fastening the pair of leg wraps 130 around the legs of the user 40 above the knees on each side; step three 503, holding the first-end 112 as a handle by an assistant 50 while the user 40 is in motion such that resistance is applied to the legs of the user 40; and step four

504, changing a resistance weight of the resistance band 120 to provide differing resistance to stretching.

It should be noted that step four 504 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using the resistance band system 500 (e.g., different step orders within above-mentioned list, elimination or addition of certain steps, including or excluding certain maintenance steps, etc.), are taught herein.

Those with ordinary skill in the art will now appreciate that upon reading this specification and by their understanding the art of resistance bands as described herein, methods of using resistance bands will be understood by those knowledgeable in such art.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A resistance band system for leg cycle training, the resistance band system comprising:

a strap including a first-end, a second-end, and a length member therebetween;

a resistance band having a first-connection point at one end and a second-connection point at an opposing end;

a pair of leg wraps connected to the first-connection point and the second-connection point, respectively, and configured to fasten around a user's legs above the knees; and a plurality of connectors connecting the pair of leg wraps to the first-connection point and the second-connection point and connecting the second-end of the strap to a middle-point along the resistance band;

wherein the first-end and the second-end each forms a loop;

wherein the resistance band threads through the loop at the second-end and is configured to be retained at the middle-point; and wherein the first-end is a handle configured to be held by an assistant while the user is fastened to the pair of leg wraps.

2. The resistance band system of claim 1, wherein the length of the strap is at least 3 feet.

3. The resistance band system of claim 1, wherein the strap comprises a webbing fabric.

4. The resistance band system of claim 3, wherein the strap comprises a pliable metal insert covered by the webbing fabric.

5. The resistance band system of claim 1, wherein the pair of leg wraps are adjustably fastened around the legs of the user above the knees with hook-and-loop fasteners.

6. The resistance band system of claim 1, wherein the pair of leg wraps are configured to fasten at least ½ inch above the knees.

7. The resistance band system of claim 1, wherein the resistance band comprises an elastic material.

8. The resistance band system of claim 1, wherein the resistance band is interchangeable to different weight resistances to provide differing resistance to stretching.

9. The resistance band system of claim 8, wherein one of the weight resistances is at least 10 pounds.

10. The resistance band system of claim 1, wherein the resistance band is a minimum of 6 feet and a maximum of 8 feet.

11. The resistance band system of claim 1, wherein the plurality of connectors are rings.

12. The resistance band system of claim 1, wherein the plurality of connectors are clamps.

13. The resistance band system of claim 1, wherein the plurality of connectors are clips.

14. A resistance band system, the resistance band system comprising:

a strap including a first-end, a second-end, and a length member therebetween;

a resistance band having a first-connection point at one end and a second-connection point at an opposing end;

a pair of leg wraps connected to the first-connection point and the second-connection point and configured to fasten around a user's legs above the knees;

a plurality of connectors connecting the pair of leg wraps to the first-connection point and the second-connection point and connecting the second-end of the strap to a middle-point along the resistance band;

wherein the first-end and the second-end each forms a loop;

wherein the resistance band threads through the loop at the second-end and is configured to be retained at the middle-point;

wherein the first-end is a handle configured to be held by an assistant while the user is fastened to the pair of leg wraps;

wherein the length of the strap is at least 3 feet;

wherein the strap comprises a webbing fabric;

wherein the pair of leg wraps are adjustably fastened around the legs of the user above the knees with hook-and-loop fasteners;

wherein the pair of leg wraps are configured to fasten at least ½ inch above the knees;

wherein the resistance band comprises an elastic material;

wherein the resistance band is interchangeable to different weight resistances to provide differing resistance to stretching;

wherein one of the weight resistances is at least 10 pounds;

wherein the resistance band is a minimum of 6 feet and a maximum of 8 feet; and wherein the plurality of connectors are clamps.

15. The resistance band system of claim 14, further comprising a set of instructions; and wherein the resistance band system and instructions are arranged as a kit.

16. A method of using a resistance band system, the method comprising the steps of:

providing a strap including a first-end, a second-end, and a length member therebetween; a resistance band having a first-connection point at one end and a second-connection point at an opposing end; a pair of leg wraps connected to the first-connection point and the second-connection point and configured to fasten around a user's legs above the knees; and a plurality of connectors connecting the pair of leg wraps to the first-connection point and the second-connection point and connecting the second-end of the strap to a middle-point along the resistance band; wherein the first-end and the second-end each forms a loop; wherein the resistance band threads through the loop at the second-end and is configured to be retained at the middle-point;

fastening the pair of legs wraps around a user's leg above the knees; and holding the first-end as a handle by an assistant while the user is in motion such that resistance is applied to the legs of the user.

17. The method of claim 16, further comprising the step of changing a resistance weight of the resistance band to provide differing resistance to stretching.

* * * * *